US008936334B2

(12) United States Patent
Hasegawa et al.

(10) Patent No.: US 8,936,334 B2
(45) Date of Patent: Jan. 20, 2015

(54) PRINTING METHOD AND PRINTING DEVICE

(71) Applicant: Seiko Epson Corporation, Tokyo (JP)

(72) Inventors: Tomonaga Hasegawa, Nagano (JP); Kazuyoshi Tanase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/932,607

(22) Filed: Jul. 1, 2013

(65) Prior Publication Data

US 2014/0009520 A1 Jan. 9, 2014

(30) Foreign Application Priority Data

Jul. 5, 2012 (JP) ..... 2012-151143

(51) Int. Cl.
*B41J 29/38* (2006.01)
*B41J 2/11* (2006.01)
*B41J 2/21* (2006.01)

(52) U.S. Cl.
CPC . *B41J 2/11* (2013.01); *B41J 2/2132* (2013.01)
USPC ..... 347/9; 347/12

(58) Field of Classification Search
USPC ..... 347/9, 12
See application file for complete search history.

(56) References Cited

U.S. PATENT DOCUMENTS

| | | | | |
|---|---|---|---|---|
| 6,702,415 | B2 | 3/2004 | Kanda et al. | |
| 6,712,443 | B2 | 3/2004 | Kanda et al. | |
| 8,403,442 | B2 | 3/2013 | Miyashita et al. | |
| 2009/0256871 | A1 * | 10/2009 | Toyama et al. | 347/7 |
| 2011/0261100 | A1 * | 10/2011 | Miyashita et al. | 347/12 |

FOREIGN PATENT DOCUMENTS

| | | | |
|---|---|---|---|
| JP | 2002-166535 | A | 6/2002 |
| JP | 2003-053963 | A | 2/2003 |
| JP | 2005-177992 | A | 7/2005 |
| JP | 2011-230295 | A | 11/2011 |

* cited by examiner

*Primary Examiner* — Jason Uhlenhake
(74) *Attorney, Agent, or Firm* — Global IP Counselors, LLP

(57) ABSTRACT

A printing method where ink is discharged by a nozzle row, which has a plurality of nozzles, being relatively moved in a main scanning direction and a sub-scanning direction with regard to a print medium, and printing of a print image is performed to be formed of an independent region where raster lines, which are dot rows lined up in the main scanning direction, are completed in one main scanning and an overlapping region where the raster lines are completed in a plurality of main scannings, the printing method comprising: allocating whether each of the dots of the overlapping region is formed in either a preceding main scanning or a following main scanning in the plurality of main scannings; and performing the preceding main scanning and the following main scanning in an order which corresponds to the result of the allocating.

6 Claims, 8 Drawing Sheets

| FOUR DOT DISCHARGE PATTEN | | | | INK WEIGHT |
|---|---|---|---|---|
| ○ | ○ | ○ | ○ | NO CHANGE |
| ○ | × | ○ | × | REDUCTION |
| ○ | ○ | × | × | NO CHANGE |
| ○ | × | × | × | REDUCTION |

○ : HIT × : NO HIT

PRINTING METHOD AND PRINTING DEVICE

CROSS-REFERENCE TO RELATED APPLICATIONS

This application claims priority to Japanese Patent Application No. 2012-151143 filed on Jul. 5, 2012. The entire disclosure of Japanese Patent Application No. 2012-151143 is hereby incorporated herein by reference.

BACKGROUND

1. Technical Field

The present invention relates to a method and a device where printing is performed.

2. Background Technology

In an ink jet printer which is one type of printing device, due to alternately repeating a dot forming action where dots are formed on a sheet of paper by ink being discharged from a nozzle row on a printing head which moves in a main scanning direction and a transport action where the sheet of paper is transported in a sub-scanning direction, an image is printed by a plurality of dot rows (raster lines) along the main scanning direction being lined up in the sub-scanning direction on the sheet of paper.

Although it is possible to print bands which correspond to the width of a nozzle row by one movement in the main scanning direction, a method is known where printing is performed such that a portion overlaps with the previous band when the next band is printed (for example, refer to PTL 1). The printing method is referred to as "partial overlapping printing" and suppresses the generation of white streaks and density irregularities at the border between one band and another band.

Japanese Laid-open Patent Publication No. 2011-230295 (Patent Document 1) is an example of the related art.

A printing head has a characteristic where the ink weight which is discharged by the discharge cycle changes. In particular, in a case where ink discharging is independently performed only once instead of being continuously performed a plurality of times, the ink weight which is able to be discharged is insufficient with regard to a specified amount. As a result, there are problems in that the ink discharge amount is insufficient and it is not possible to sufficiently suppress the generation of density irregularities in the overlapping region.

SUMMARY

Problems to be Solved by the Invention

The invention is carried out in order to solve the problem described above and has an advantage of suppressing generation of density irregularities in an overlapping region.

Means Used to Solve the Above-Mentioned Problems

The invention is carried out in order to solve at least a portion of the problem described above and is able to be executed in the below formats or application examples.

Application Example 1

A printing method where ink is discharged by a nozzle row, which has a plurality of nozzles, being relatively moved in a main scanning direction and a sub-scanning direction with regard to a print medium, and printing of a print image is performed to be formed of an independent region where raster lines, which are dot rows lined up in the main scanning direction, are completed in one main scanning and an overlapping region where the raster lines are completed in a plurality of main scannings, the printing method including allocating whether each of the dots of the overlapping region is formed in either a preceding main scanning or a following main scanning in the plurality of main scannings, and performing the preceding main scanning and the following main scanning in an order which corresponds to the result of the allocating, where the allocating is performed such that the lining up of the dots which are respectively formed in the preceding main scanning and the following main scanning are easily aggregated into a collection of a plurality of dots.

According to the printing method with this configuration, the lining up of the dots which are respectively formed in the preceding main scanning and the following main scanning are easily aggregated into a collection of a plurality of dots. As a result, since the forming of one dot independently is reduced, the forming of the dots where the ink weight is insufficient with regard to a specified amount is reduced. Accordingly, it is possible to suppress the generation of density irregularities in the overlapping region.

Application Example 2

The printing method described in application example 1 wherein the allocating is performed by executing a masking process using a mask for use with the overlapping region with regard to binary data for printing after a half tone process, and a mask which has an excellent ON data aggregation property is used as the mask rather than a mask which has an excellent discreteness which is created with a predetermined method. According to this configuration, it is possible to easily realize the allocating by using the mask which has an excellent ON data aggregation property rather than a well-known mask.

Application Example 3

The printing method described in application example 2 where, in the allocating, a mask which has excellent discreteness is acquired and a mask for the masking process is generated by expanding data of each element of the mask which has excellent discreteness into data of two elements which are lined up in the row direction. According to this configuration, it is possible to realize the allocating reliably and with a simple configuration.

Application Example 4

A printing device which discharges ink by relatively moving a nozzle row, which has a plurality of nozzles, in a main scanning direction and a sub-scanning direction with regard to a print medium, and performs printing of a print image which is formed of an independent region where raster lines, which are dot rows lined up in the main scanning direction, are completed in one main scanning and an overlapping region where the raster lines are completed in a plurality of main scannings, with the printing device including an allocation processing section which allocates whether each of the dots of the overlapping region is formed in either a preceding main scanning or a following main scanning in the plurality of main scannings, and a printing execution section which executes the preceding main scanning and the following main scanning in an order which corresponds to an allocation result, where the allocation processing section performs the allocating such that the lining up of the dots which are respectively formed in the preceding main scanning and the following main scanning are easily aggregated into a collection of a plurality of dots. In the same manner as the printing method of application example 1, it is possible for the printing device of application example 4 to suppress the generation of density irregularities in the overlapping region.

Furthermore, it is possible for the invention to be realized as various formats other than the above application examples, and for example, to be realized as a printing system which includes the printing device, a printing control device which is provided with each of the sections which are included in the printing device, a format as a computer program which is executed with each of the steps which are included in the printing method as a function, the computer program, a format such as a printing medium where the computer program is recorded, and the like.

BRIEF DESCRIPTION OF THE DRAWINGS

Referring now to the attached drawings which form a part of this original disclosure.

DETAILED DESCRIPTION OF EXEMPLARY EMBODIMENTS

Below, an embodiment of the invention will be described based on an applied example in accordance with the ordering described below.

A. Applied Example:
A1. Configuration of Printing System:
A2. Nozzle Row and Partial Overlapping Printing:
A3. Printing Process:
A4. Allocation Process:
A5. Mask Generating Method:
A6. Effects of Applied Example:
B. Modified Examples

A. Applied Example

A1. Configuration of Printing System

Figure 1:
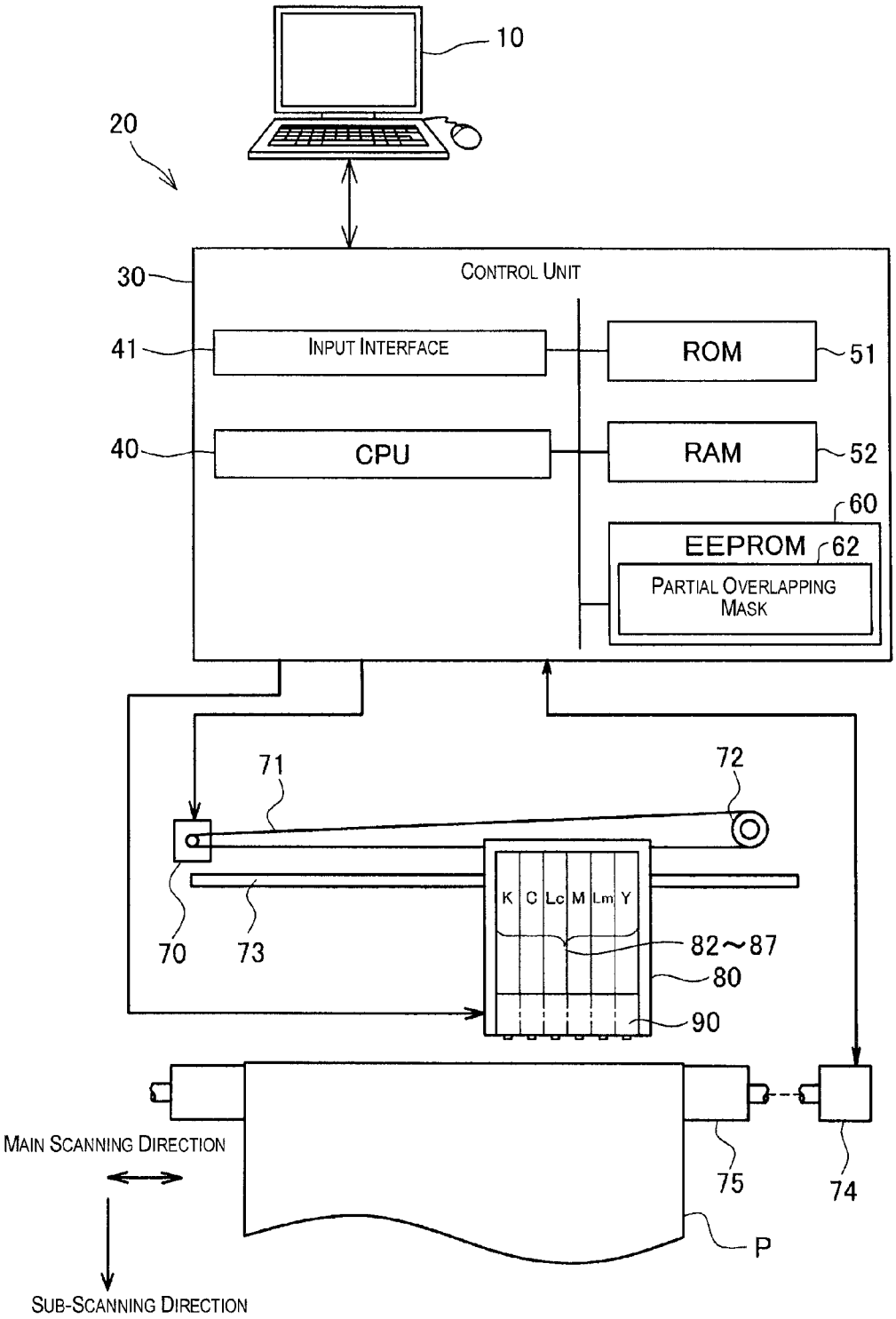
FIG. 1 is an explanatory diagram illustrating a configuration of a printing system of an applied example of the invention.

FIG. 1 is an explanatory diagram illustrating a configuration of a printing system of the applied example. The printing system is provided with a computer 10 and a printer 20. The computer 10 sends data (referred to below as "image data for printing") for printing to the printer 20. The printer 20 receives the image data for printing from the computer 10 and prints an image on a sheet of paper (print medium) P based on the image data for printing.

The printer 20 is a serial type ink jet printer and is provided with a control unit 30, a carriage motor 70, a driving belt 71, a pulley 72, a sliding shaft 73, a paper feeding motor 74, a paper feeding roller 75, a carriage 80, ink cartridges 82-87, and a printing head 90.

The control unit 30 is provided with a CPU 40, an input interface 41, a ROM 51, a RAM 52, and an EEPROM 60. A flash memory can be adopted in the control unit 30 instead of the EEPROM 60. The EEPROM 60 stores a partial overlapping mask 62. The partial overlapping mask 62 is configured by a plurality of mask data, but the mask data will be described in detail later. The CPU 40 controls of all the actions of the printer 20 by a program which is recorded in the ROM 51 or the EEPROM 60 being loaded into the RAM 52 and being executed. The input interface 41 receives print data from the computer 10.

The driving belt 71 is stretched between the carriage motor 70 and the pulley 72. The carriage 80 is attached to the driving belt 71. Ink cartridges 82 to 87 for color inks where cyan ink (C), magenta ink (M), yellow ink (Y), black ink (K), light cyan ink (Lc), and light magenta ink (Lm) are each accommodated as color inks are mounted to the carriage 80. Nozzle rows which correspond to each of the colors of the color inks described above are formed in the printing head 90 at a lower section of the carriage 80. When the ink cartridges 82 to 87 are mounted into the carriage 80 from above, it is possible to supply ink to the printing head 90 from each of the cartridges. The sliding shaft 73 is arranged parallel to the driving belt and passes through the carriage 80. Here, the color inks are not limited to the six colors described above and can be, for example, less than six colors such as one color of only K or three colors of C, M, and Y, or can be a number of colors which exceeds six.

When the carriage motor 70 drives the driving belt 71, the carriage 80 moves along the sliding shaft 73. The direction is referred to as the "main scanning direction". Along with the movement of the carriage 80 in the main scanning direction, the ink cartridges 82 and the 87 and the printing head 90 also move in the main scanning direction. By ejecting the inks in the ink cartridges 82 to 87 from the print nozzles (which will be described later) which are arranged in the printing head 90 onto the sheet of paper P during the movement in the main scanning direction, printing on the sheet of paper P is executed. One main scanning is referred to as a "pass".

The paper feeding roller 75 is connected to the paper feeding motor 74. During printing, the sheet of paper P is inserted in the top of the paper feeding roller 75. When the carriage 80 is moved to the end section in the main scanning direction, the control unit 30 rotates the paper feeding motor 74. Due to this, the paper feeding roller 75 is also rotated and the sheet of paper P is moved. The relative moving direction of the sheet of paper P and the printing head 90 is referred to as the "sub-scanning direction".

A2. Nozzle Row and Partial Overlapping Printing

Figure 2:
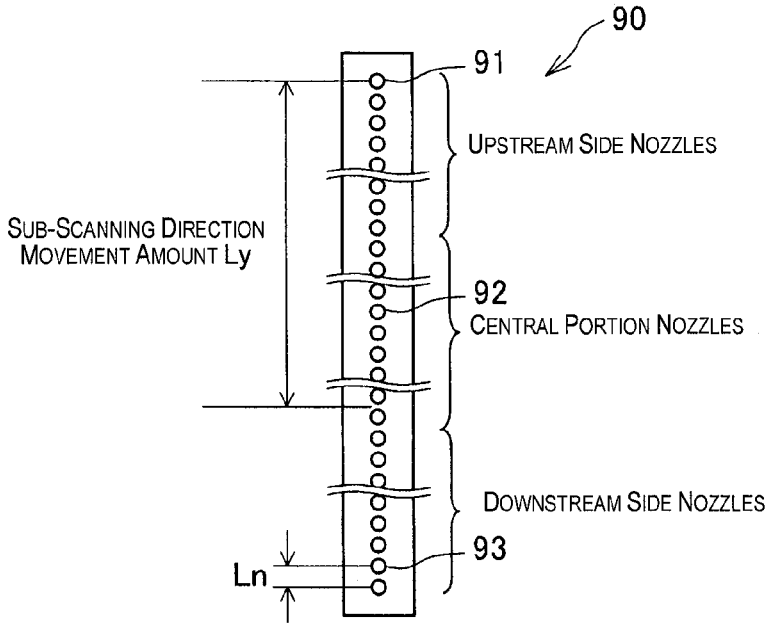
FIG. 2 is an explanatory diagram illustrating a nozzle row of the printing head.

FIG. 2 is an explanatory diagram illustrating a nozzle row of the printing head. The nozzle row shown in FIG. 2 is a nozzle row for one color. In the applied example, since there are six colors, the printer 20 is provided with a total of six rows with the nozzle row shown in FIG. 2 being one row for each of the colors. The nozzle rows are provided as a plurality of upstream side nozzles 91, a plurality of central portion nozzles 92, and a plurality of downstream side nozzles 93. The upstream side nozzles 91 and the downstream side nozzles 93 are nozzles which have a role as a nozzle group which is used during the overlapping printing. The number of the upstream side nozzles 91 and the number of the downstream side nozzles 93 are the same. A distance (nozzle pitch) Ln between the adjacent nozzles out of each of the nozzles 91 to 93 is double the pitch of a pixel array during the printing. The movement amount of the sheet of paper P in the sub-scanning direction is a length Ly where half of the nozzle pitch (Ln/2) is subtracted from a length where Ln/2, the length of a portion of the upstream side nozzles 91, and the length of a portion of the central portion nozzles 92 are added.

Figure 3A:
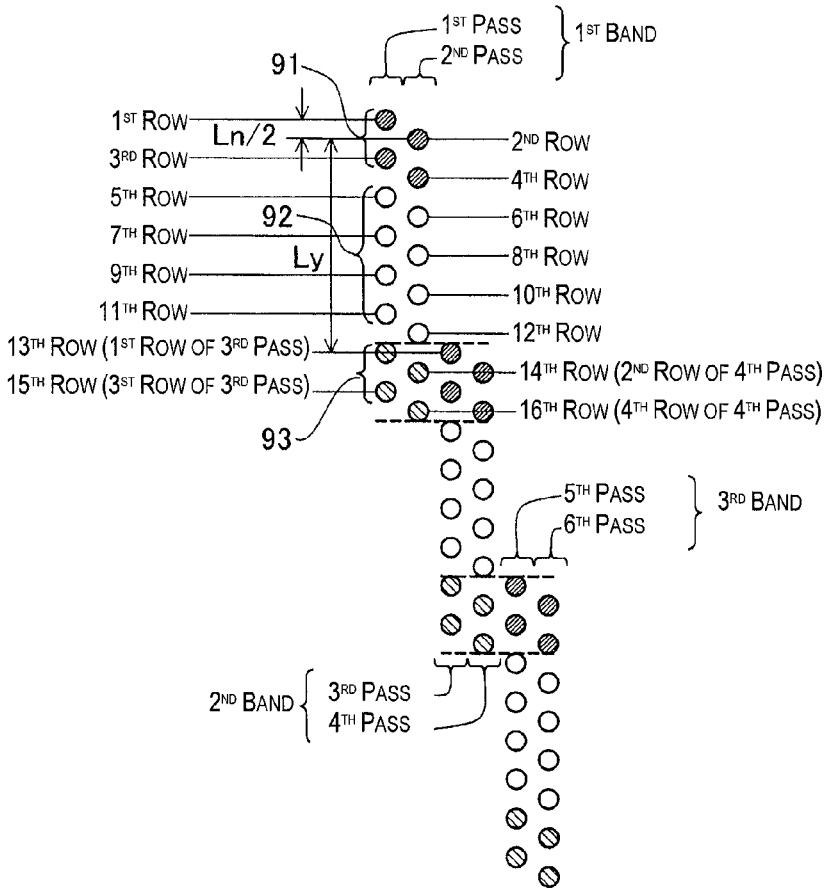
FIGS. 3A and 3B are explanatory diagrams illustrating partial overlapping printing.
Figure 3B:
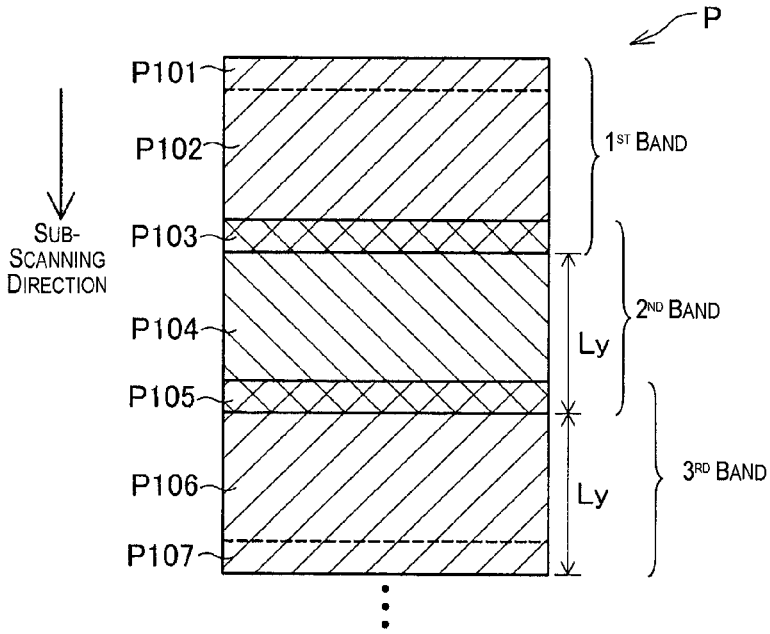

FIGS. 3A and 3B are explanatory diagrams illustrating partial overlapping printing. FIG. 3A illustrates the manner in which the nozzles 91 to 93 shown in FIG. 2 execute printing in each pass order and, here, FIG. 3A describes where there are two of the upstream side nozzles 91, four of the central portion nozzles 92, and two of the downstream side nozzles 93. Here, each of the numbers has only been reduced for convenience of description and it is not necessary to be limited to these numbers. In a first pass, eight of the nozzles 91 to 93 print row numbers 1, 3, 5, 7, 9, 11, 13 and 15 (the odd-numbered rows). After the printing of the first pass, the control unit 30 relatively moves the sheet of paper P in the sub-scanning direction by Ln/2 with regard to the printing head 90. Then, in a second pass, eight of the nozzles 91 to 93 print row numbers 2, 4, 6, 8, 10, 12, 14, and 16 (the even-numbered rows). In the applied example, the region which is printed by the second pass is referred to as a "pseudo band" or simply a "band". Here, in a case of referring to the "n-th" row, it is assumed to indicate the "n-th" row in one band.

When the eight nozzles 91 to 93 complete the printing of the second pass, the control unit 30 relatively moves the sheet of paper P in the sub-scanning direction by Ln/2 only with regard to the printing head 90. Then, a third pass is printed in the same manner as the first pass. At this time, the first and third rows of the third pass are rows which are respectively the same as the thirteenth and fifteenth rows of the first pass. The eight nozzles 91 to 93 print a fourth pass in the same manner as the second pass. At this time, the second and fourth rows of the fourth pass are rows which are respectively the same as the fourteenth and sixteenth rows of the second pass. Below, in the same manner, the eight nozzles 91 to 93 print the fifth and sixth passes and so on.

FIG. 3B illustrates a printing state on the sheet of paper P using bands. On the sheet of paper P, regions P101 to P103 are printed in a first band. Here, the region P101 is a region which is printed by the upstream side nozzles 91, the region P102 is a region which is printed by the center portion nozzles 92, and the region P103 is a region which is printed by the downstream side nozzles 93. On the sheet of paper P, regions P103 to P105 are printed in a second band. In the second band, the region P103 is a region which is printed by the upstream side nozzles 91, the region P104 is a region which is printed by the center portion nozzles 92, and the region P105 is a region which is printed by the downstream side nozzles 93. That is, a portion of the region P103 is printed by the downstream side nozzles 93 during the printing of the first band and the remaining portion is printed by the upstream side nozzles 91 during the printing of the second band. On the other hand, the region P102 or P104 is printed only by the central portion nozzles 92.

In this manner, when moving the sheet of paper P and the printing head in the sub-scanning direction and printing the next band, where a portion in the sub-scanning range is printed so as to overlap is referred to as "partial overlapping printing" and a region which is printed by a plurality of bands are referred to as an "overlapping region". For example, the regions P103 to P105 correspond to one "band" and the regions P103 and P105 each correspond to an "overlapping region". In the same manner, the regions P105 to P107 are printed as the third band, the region P105 is printed so as to overlap, and the region P107 is printed so as to overlap in the fourth band (which is not shown in the diagram). The region which is printed by the upstream side nozzles 91 and the downstream side nozzles 93 is printed by two bands (four passes) and the region which is printed by the central portion nozzles 92 is printed by one band (two passes). However, the region which is printed by the upstream side nozzles 91 during the initial band printing and the region which is printed by the downstream side nozzles 93 during the final band printing on the sheet of paper P are printed by band printing (two passes) one time only.

Here, the regions P102, P104, and P106 which are printed by the central portion nozzles 92 correspond to the "independent regions" in the application example 1. The dot rows (raster lines) which are included in the independent regions and lined up in the main scanning direction are completed in one pass. On the other hand, the raster lines which are included in the overlapping regions P103, P105, and P107 along the main scanning direction are completed by two passes.

A3. Printing Process

Figure 4:
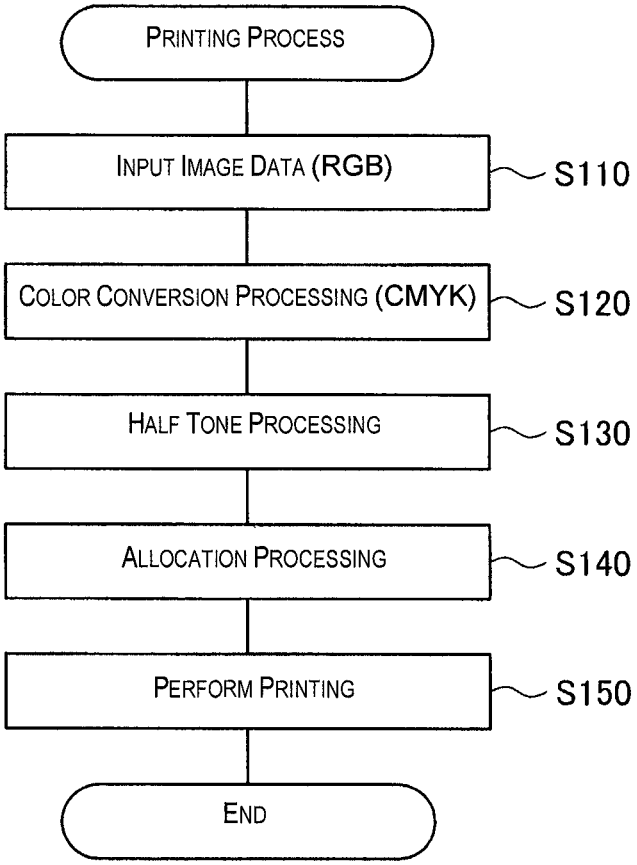
FIG. 4 is a flowchart illustrating a flow of a printing process in a printer.

The printing process in the printer 20 will be described. FIG. 4 is a flowchart illustrating a flow of the printing process in the printer 20. The printing process is started by receiving a printing instruction for a predetermined image from the computer 10. When the printing process is started, first, the CPU 40 receives RGB format image data for printing, which is the printing object sent from the computer 10, via the input interface 41 (step S110).

When the image data for printing is received, the CPU 40 refers to a look up table (which is not shown in the diagram), which is recorded in the EEPROM 60, and converts color in the RGB format to a CMYK format based on the image data for printing (step S120).

When the color conversion processing is performed, the CPU 40 performs half tone processing which converts the CMYK data with a high number of gradations into ON/OFF data of the dots of each of the colors (step S130). For example, due to the half tone processing, data which expresses 256 gradations is converted to 1 bit data which expresses 2 gradations and 2 bit data which expresses 4 gradations. In the half tone processing, a dither method, γ correction, an error diffusion method, or the like is used. Here, the half tone processing is not limited to binarization processing of the ON/OFF of the dots and can be multi-level processing such as the ON/OFF of large dots and small dots. In addition, the data which undergoes step S130 can be subjected to image processing such as resolution conversion processing or smoothing processing.

When the half tone processing is completed, the CPU 40 performs an allocation process which allocates whether dots are formed at either a preceding band or a following band at each of the dot forming positions in the overlapping region (step S140). The "preceding band" is a band which is printed first at the time when the overlapping region is printed and, for example, the preceding band corresponds to the first band in the overlapping region P103 in FIG. 3B. The "following band" is a band which is printed last at the time when the overlapping region is printed and, for example, the following band corresponds to the second band in the overlapping region P103 in FIG. 3B. The allocation process is performed individually for each of the colors of the nozzle rows. The allocation process of step S140 will be described in detail later. When the allocation process is completed, after this, the CPU 40 drives the printing head 90, the paper feeding motor 74, and the like and executes printing (step S150). In the overlapping region, printing of the preceding band and printing of the following band are performed in order. In this manner, the printing process is completed. The allocation process of step S140 corresponds to the "allocating" in the application example 1 and the performing of the printing of step S150 corresponds to the "performing" in the application example 1.

A4. Allocation Process

Figure 5:
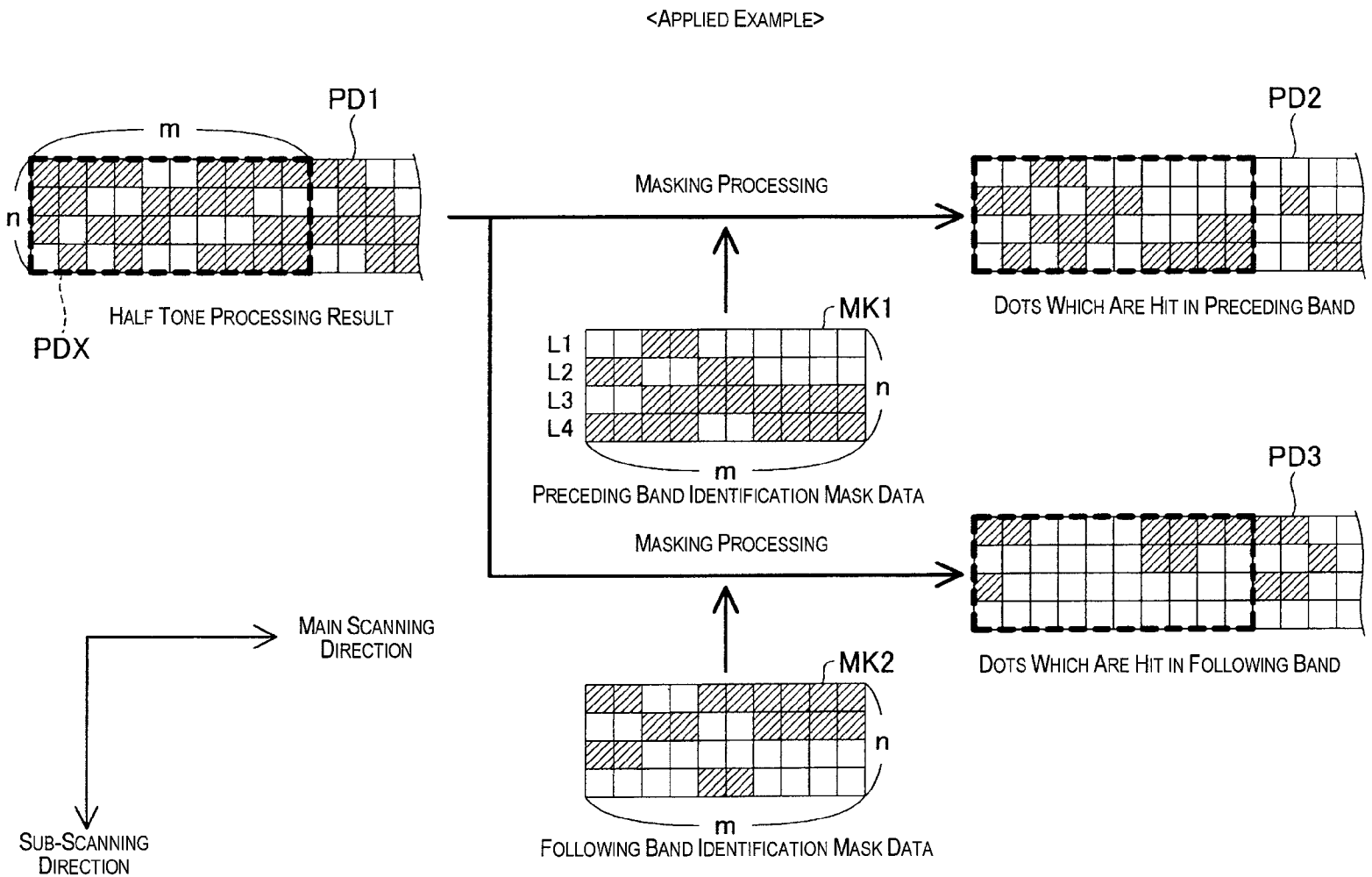
FIG. 5 is an explanatory diagram illustrating an allocation process which is executed by step S140.

FIG. 5 is an explanatory diagram illustrating the allocation process which is performed by step S140. Binary data PD1 exemplifies the result of the half tone processing (step S130) of the overlapping regions P103 and P105 (FIG. 3B) and the diagram shows the lengths which are omitted in the main scanning direction. In the binary data PD1, the squares with hatching indicate pixels which are determined to be dot ON in the half tone processing and the squares without hatching indicate pixels which are determined to be dot OFF in the half tone processing.

In the allocation process, the masking process is carried out with regard to the binary data PD1 using preceding band identification mask data MK1 and following band identification mask data MK2. In the preceding band identification mask data MK1, for each pixel which is printed in the overlapping region, the positions of the pixels which form dots using the downstream side nozzles 93 during the printing of the preceding band are recorded. In the preceding band identification mask data MK1, the squares with hatching indicate pixels which form dots (set as dot ON) using the downstream side nozzles 93 during the printing of the preceding band and the squares without hatching indicate pixels which do not form dots (set as dot OFF).

In the following band identification mask data MK2, for each pixel which is printed in the overlapping region, the positions of the pixels which form dots using the upstream side nozzles 91 during the printing of the following band are recorded. In the following band identification mask data MK2, the squares with hatching indicate pixels which form dots (set as dot ON) using the upstream side nozzles 91 during the printing of the following band and the squares without hatching indicate pixels which do not form dots (set as dot OFF). Here, the preceding band identification mask data MK1 and the following band identification mask data MK2 are the same size and the ON/OFF of the dots in the preceding band identification mask data MK1 and the ON/OFF of the dots in the following band identification mask data MK2 have configurations which are inversions of each other.

By carrying out the masking process on the binary data PD1 using the preceding band identification mask data MK1, it is possible to determine the pixels where the forming of the dots is performed by the downstream side nozzles 93 during the printing of the preceding band in the binary data PD1. Specifically, the preceding band identification mask data MK1 is multiplied by the binary data PD1 and an overlapping portion (a portion which is determined by a logical product) of the pixels of the dots ON of the binary data PD1 and the pixels of the dots ON of the preceding band identification mask data MK1 is binary data (referred to as preceding band side binary data) PD2 where dots are formed by the downstream side nozzles 93 during the printing of the preceding band. A portion PDX which is surrounded by thick line hatching in the diagram is a multiplied portion and the multiplied portion PDX sequentially moves to each lateral direction size (number of squares in a direction which is along the main scanning direction) m of the preceding band identification mask data MK1 from one end of the main scanning direction toward the other end. In the applied example, the vertical direction size (number of squares in a direction which is along the sub-scanning direction) n of the preceding band identification mask data MK1 is the same size as the sub-scanning direction of the overlapping region and it is possible to execute the masking process according to the preceding band identification mask data MK1 with regard to the whole of the overlapping region simply by moving the preceding band identification mask data MK1 once in the main scanning direction.

Here, in the example in the diagram, m=10 and n=4, but these values have only been reduced for convenience of illustration and it is not necessary to be limited to these sizes. In addition, it is not necessarily necessary for the vertical direction size n of the preceding band identification mask data MK1 to be the same as the size of the overlapping region in the sub-scanning direction and the vertical direction size n can be smaller than the size of the overlapping region in the sub-scanning direction. In this case, it is preferable that the vertical direction size n be determined such that n×k (k is an integer of 2 or more) is equal to the size of the overlapping region in the sub-scanning direction. By moving the preceding band identification mask data MK1 in the main scanning direction once, after this, moving the preceding band identification mask data MK1 in the sub-scanning direction, and after this, repeating the action of moving in the main scanning direction, it is possible to multiply the preceding band identification mask data MK1 by the whole of the overlapping region.

Furthermore, by carrying out the masking process on the binary data PD1 using the following band identification mask data MK2, it is possible to determine the pixels where the forming of the dots is performed by the upstream side nozzles 91 during the printing of the following band in the binary data PD1. Specifically, the following band identification mask data MK2 is multiplied by the binary data PD1 and an overlapping portion (a portion which is determined by a logical product) of the pixels of the dot ON of the binary data PD1 and the pixels of the dot ON of the following band identification mask data MK2 is binary data (referred to as following band side binary data) PD3 where dots are formed by the upstream side nozzles 91 during the printing of the following band. In the same manner as the time when the preceding band identification mask data MK1 is used, the multiplied portion is moved in the main scanning direction (or both the main scanning direction and the sub-scanning direction). As a result, with regard to the whole of the overlapping region, it is possible to execute the masking process using the following band identification mask data MK2.

A5. Mask Generating Method

In the applied example, the preceding band identification mask data MK1 is generated by modifying the partial overlapping mask 62 which is stored in the EEPROM 60. A plurality of mask data according to printing conditions such as the print medium, the resolution, and the dot size at the time when printing is performed are recorded in advance in the EEPROM 60 as the partial overlapping mask 62. The mask data is generated by a dither method and the ON data is arranged discretely. Here, it is not necessary for the generation method to be limited to the dither method, and it is possible to adopt any method which has excellent discreteness such that γ correction, an error diffusion method, or the like. The CPU 40 reads out the mask data, which corresponds to the print conditions at the time of printing, from the EEPROM 60, sets the mask data which has been read out as the basic mask data, and generates the preceding band identification mask data MK1 from the basic mask data.

Figure 6:
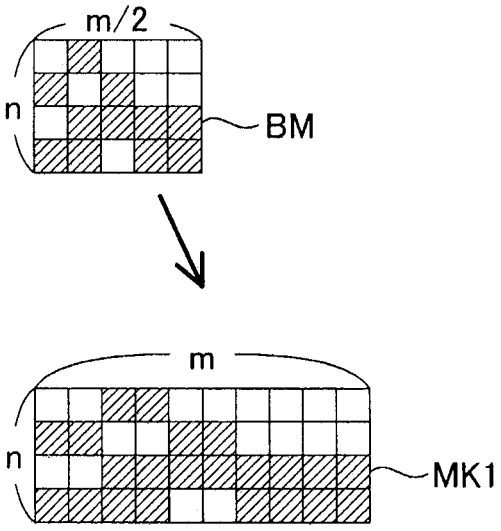
FIG. 6 is an explanatory diagram which exemplifies aggregation.

FIG. 6 is an explanatory diagram illustrating the method where the preceding band identification mask data MK1 is generated from the basic mask data. Compared to the preceding band identification mask data MK1 (which is the same as is shown in FIG. 5), basic mask data BM has half the lateral direction size and the same vertical direction size. The ON/OFF pattern of the basic mask data BM is discrete as described above. The preceding band identification mask data MK1 is generated by the data of each of the elements of the basic mask data being expanded into data of two elements which are lined up in the row direction.

That is, when looking at the first row, since the elements of the first row of the basic mask data BM are OFF data, each of the elements of the first row and the second row of the preceding band identification mask data MK1 are determined to be OFF data. Next, since the elements of the second row of the basic mask data BM are ON data, each of the elements of the third row and the fourth row of the preceding band identification mask data MK1 are determined to be ON data. Subsequently, since the elements of the third row of the basic mask data BM are OFF data, each of the elements of the fifth row and the sixth row of the preceding band identification mask data MK1 are determined to be OFF data. Since the elements of the fourth row of the basic mask data BM are OFF data, each of the elements of the seventh row and the eighth row of the preceding band identification mask data MK1 are determined to be OFF data. Since the elements of the fifth row of the basic mask data BM are OFF data, each of the elements of the ninth row and the tenth row of the preceding band identification mask data MK1 are determined to be OFF data. In the same manner, the data of each of the elements from the second row to the fourth row is expanded into data of two elements which are lined up in the row direction. As a result, as shown in the diagram, the preceding band identification mask data MK1 of the fourth row and the tenth row which is twice the size of the basic mask data BM is generated.

The following band identification mask data MK2 is generated by reversing the ON/OFF of the preceding band identification mask data MK1 which is generated as described above. The resulting preceding band identification mask data MK1 and the following band identification mask data MK2 are configured such that the ON data is aggregated and arranged at each even number in the row direction. By using the preceding band identification mask data MK1 and the following band identification mask data MK2 which have such configurations, as shown in FIG. 5, the preceding band side binary data PD2 and the following band side binary data PD3 are divided such that the pixels which are set as dot ON are aggregated in units of two at a time or a number which is higher than this at a high ratio in the line direction.

Figure 7:
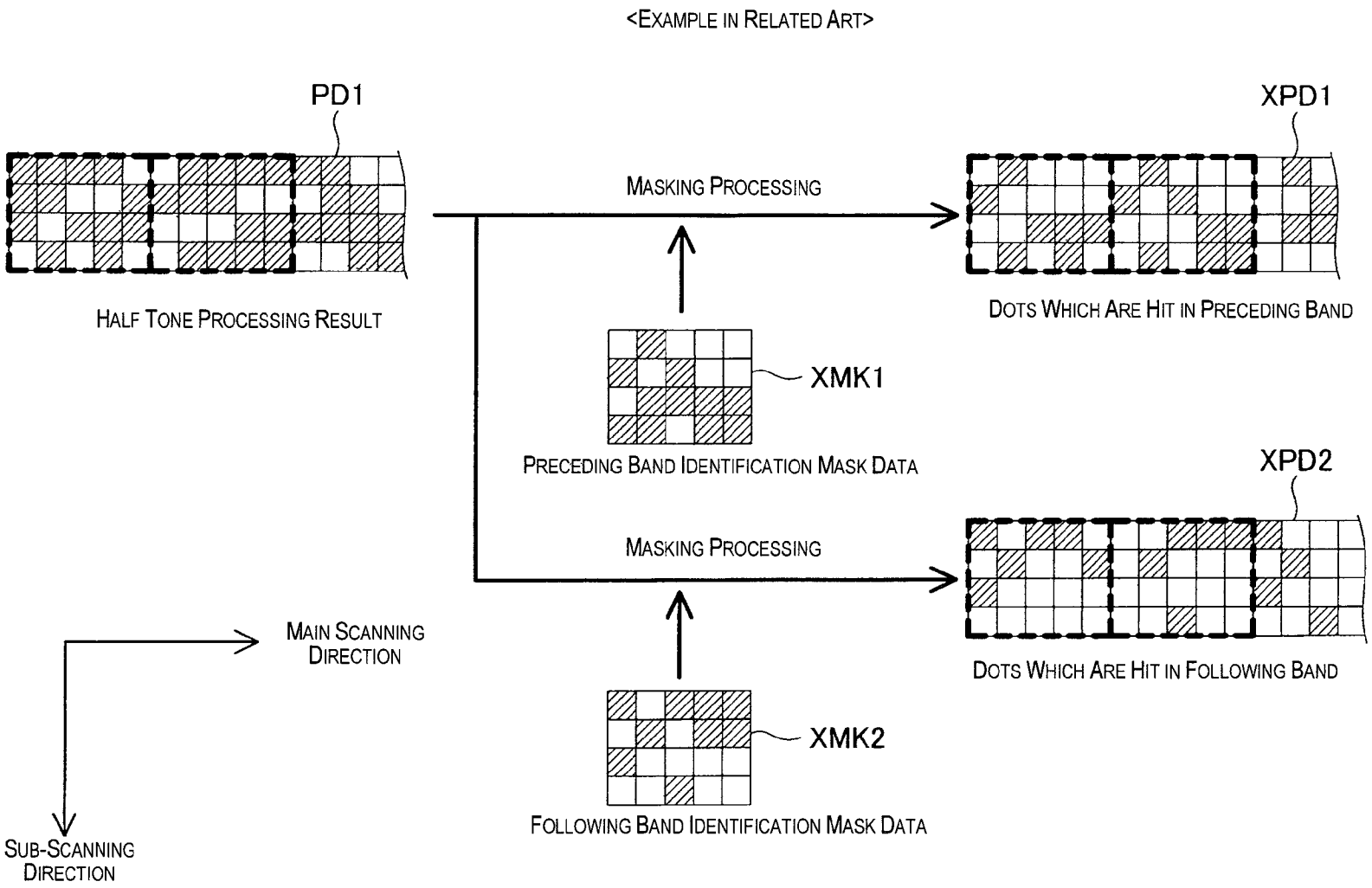
FIG. 7 is an explanatory diagram illustrating an allocation process in a case of using preceding band identification mask data and following band identification mask data in the related art.

FIG. 7 is an explanatory diagram illustrating the allocation process in a case of using preceding band identification mask data XMK1 and following band identification mask data XMK2 in the related art. The preceding band identification mask data XMK1 in the related art corresponds to the basic mask data BM at the time of creating the preceding band identification mask data MK1 of the applied example shown in FIG. 5. That is, both of the mask data XMK1 and XMK2 in the related art are data which are not expanded into two element data and, as shown in the diagram, a large amount of ON data is separated (made to be discrete). The following band identification mask data XMK2 is data where the ON/OFF of the preceding band identification mask data XMK1 is reversed. The binary data PD1 is the same as in FIG. 5. Since preceding band side binary data XPD2 and following band side binary data PD3 which are obtained using both the mask data XMK1 and XMK2 are data where both the mask data XMK1 and XMK2 have high discreteness, the pixels which are set as dot ON are separated into large portions in the line direction.

Accordingly, compared to the preceding band side binary data XPD2 and the following band side binary data XPD3 of FIG. 7 according to the example in the related art, the preceding band side binary data PD2 and the following band side binary data PD3 of FIG. 5 according to the applied example form data arrays where a plurality of pixels which are set to dot ON are aggregated in the line direction and there are few separate pixels.

A6. Effects of Applied Example

As described in detail above, according to the printing system of the applied example, it is easy for the lining up of the dots which are formed in the preceding band and the lining up of the dots which are formed in the following band to be aggregated in the overlapping region into a plurality of collections of pixels which are set to dot ON in the line direction and there are few separate pixels. As a result, since the forming of single and separate dots is reduced, it is possible to sufficiently suppress the generation of density irregularities in the overlapping region for the following reasons.

Figures 8, 9:
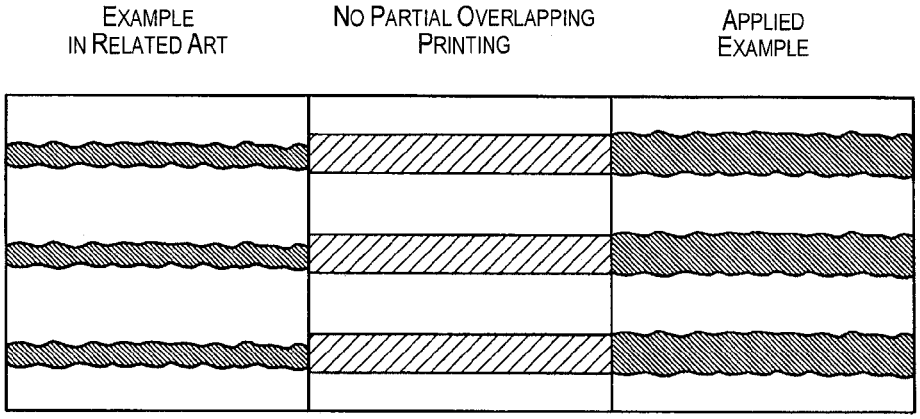
FIG. 8 is an explanatory diagram of a table illustrating changes of ink weight according to cycle characteristics.
FIG. 9 is an explanatory diagram illustrating a comparison of ruled lines which are printed using partial overlapping printing of the applied example with ruled lines which are printed using partial overlapping printing of an example in the related art.

The printing head 90 has a characteristic where the ink weight which is discharged by the discharge cycle changes. The characteristic is referred to as the "cycle characteristic" below. FIG. 8 is a table showing variation in the ink weight according to the cycle characteristic. The table shows changes in the ink weight for each single dot with regard to a discharge pattern of four dots of ink. As is understood from the table, in a case where the discharge pattern is "hit/hit/hit/hit" and a case of "hit/hit/no hit/no hit", the ink weight for each single dot does not change. On the other hand, in a case where the discharge pattern is "hit/no hit/hit/no hit" and a case of "hit/no hit/no hit/no hit", the ink weight for each single dot is reduced. That is, in a case where the hits are independently performed, the ink weight for each single dot is reduced. As a result, in the overlapping region, when the separate forming of the dots is reduced, the forming of the dots where the ink weight is insufficient with regard to a specified amount is reduced. Accordingly, it is possible to sufficiently suppress the generation of density irregularities in the overlapping region.

FIG. 9 is an explanatory diagram illustrating a comparison of ruled lines which are printed using partial overlapping printing of the applied example with ruled lines which are printed using partial overlapping printing of an example in the related art. Ruled lines when there is no partial overlapping printing are shown in the center of the diagram. As shown in the left side of the diagram, the line width of the ruled lines is thinner for the ruled lines which are printed according to the partial overlapping printing of the example in the related art compared to when there is no partial overlapping printing. On the other hand, as shown in the right side of the diagram, the line width of the ruled lines is substantially unchanged from when there is no partial overlapping printing for the ruled lines which are printed according to the partial overlapping printing of the applied example. From this result, according to the printing system of the applied example, it is understood that the generation of density irregularities in the overlapping region is improved.

B. Modified Examples

The invention is not limited to the applied example or modified example thereof, but is able to be realized in various forms in the scope which does not depart from the gist of the invention and, for example, the following modifications are also possible.

Modified Example 1

In the applied example described above, the mask data MK1 and MK2 which have an excellent ON data aggregation property have a configuration where the masking process is performed on all of the binary data PD1 in the overlapping region after the half tone processing, but alternatively, it can be set such that the binary data PD1 is divided into a plurality of blocks, it is determined whether or not the masking process is necessary for each of the blocks, and the masking process is performed only for the blocks for which it is determined to be necessary. Regarding whether or not the masking process is necessary, the ratio of the pixels which are determined to be dot ON with regard to the whole block in the block (below, referred to as "gradation ratio") is calculated and it is determined that the masking process is necessary in a case where this ratio is in a predetermined range which includes 50% (for example, 40% to 60%, 45% to 55%, or the like). When gradation ratio is 50%, the discharge pattern is "hit/no hit/hit/no hit/" when the discreteness is high. This is because since the ink weight for each single dot is reduced as described above in this case, it is desirable to perform the masking process described above. According to such a configuration, it is possible to improve the generation of density irregularities in the overlapping region without applying any correction to the data of the gradation ratio outside the predetermined range.

Modified Example 2

In the applied example described above, the overlapping region has a configuration where the raster lines are completed in two passes, but the invention is not limited to this. For example, it can have a configuration where the raster lines are completed by a number of passes other than two such as four passes.

Modified Example 3

In the applied example described above, mask data which has excellent discreteness is acquired from the EEPROM 60, the data of each of the elements of the mask data is expanded into data of two elements which are lined up in the row direction, and a mask for the masking process is generated, but the invention is not limited to this. For example, it can be that, rather than a mask which has excellent discreteness, a mask which has an excellent aggregation property is stored and this mask is acquired from the memory and set for use in the masking process.

Modified Example 4

In the applied example described above, the invention is realized at the printer side, but the invention is not limited to this. For example, the invention can be configured to be realized at the computer side. In addition, it is possible to have a configuration where an RIP (raster image processor), which is installed in a computer as software, performs a portion or all of the functions which are performed by the CPU 40. In addition, the invention can have a configuration where an RIP performs as hardware which is connected between the computer and the printer.

Modified Example 5

In the applied example described above, the ink discharging method for discharging the ink from the nozzles of the printing head in the printer is a method where the driving of piezo elements is used, but the invention is not limited to this. For example, various methods are possible such as a thermal method where bubbles are generated in the nozzles using a heating element and the ink is discharged using the bubbles, or the like.

Modified Example 6

In the applied example described above, the printer is a color printer, but alternatively, a black and white printer or a monochrome printer is possible. In addition, a metallic printer which discharges metallic ink is possible.

Modified Example 7

In the applied example described above and each of the modified examples, the functions which are realized by software can be realized by hardware, for example, discrete electronic circuits.

Here, in the constituent elements in each of the applied examples and each of the modified examples described above, it is possible for elements other than the elements which are described in the independent claims to be added or omitted as appropriate.

What is claimed is:

1. A printing method where ink is discharged by a nozzle row, which has a plurality of nozzles, being relatively moved in a main scanning direction and a sub-scanning direction with regard to a print medium, and printing of a print image is performed to be formed of an independent region where raster lines, which are dot rows lined up in the main scanning direction, are completed in one main scanning and an overlapping region where the raster lines are completed in a plurality of main scannings, the printing method comprising:

allocating whether each of dots of the overlapping region is formed in either a preceding main scanning or a following main scanning in the plurality of main scannings, the allocating being performed by executing a masking process using a mask for the masking process in the overlapping region with regard to binary data for printing after a half tone process, the mask for the masking process including, in a line direction corresponding to the main scanning direction, at least one OFF data indicating that a dot is not formed and a plurality of ON data indicating that dots are formed, all of the ON data being aggregated and arranged in the mask for the masking process such that each of all of the ON data belongs to a unit of at least two ON data that are directly adjacent with respect to each other in the line direction; and performing the preceding main scanning and the following main scanning in an order which corresponds to the result of the allocating, wherein the allocating is performed such that the lining up of the dots which are respectively formed in the preceding main scanning and the following main scanning are easily aggregated into a collection of a plurality of dots.

2. The printing method according to claim 1, wherein a mask which has an excellent ON data aggregation property is used as the mask rather than a mask which has an excellent discreteness which is created with a predetermined method.

3. The printing method according to claim 1, wherein the mask for the masking process has a vertical direction size in a vertical direction perpendicular to the line direction such that an integral multiple of the vertical direction size is equal to a size of the overlapping region in the sub-scanning direction.

4. The printing method according to claim 1, wherein the allocating includes acquiring a mask with excellent discreteness and generating the mask for the masking process by expanding the mask with excellent discreteness in the line direction by doubling a size of each data of the mask with excellent discreteness in the line direction.

5. A printing device which discharges ink by relatively moving a nozzle row, which has a plurality of nozzles, in a main scanning direction and a sub-scanning direction with regard to a print medium, and performs printing of a print image which is formed of an independent region where raster lines, which are dot rows, which are lined up in the main scanning direction are completed in one main scanning, and an overlapping region where the raster lines are completed in a plurality of main scannings, the printing device comprising:

an allocation processing section which allocates whether each of dots of the overlapping region is formed in either a preceding main scanning or a following main scanning in the plurality of main scannings, by executing a masking process using a mask for the masking process in the overlapping region with regard to binary data for printing after a half tone process, the mask for the masking process including, in a line direction corresponding to the main scanning direction, at least one OFF data indicating that a dot is not formed and a plurality of ON data indicating that dots are formed, all of the ON data being aggregated and arranged in the mask for the masking process such that each of all of the ON data belongs to a unit of at least two ON data that are directly adjacent with respect to each other in the line direction; and a printing execution section which executes the preceding main scanning and the following main scanning in an order which corresponds to an allocation result, wherein the allocation processing section performs the allocating such that the lining up of the dots which are respectively formed in the preceding main scanning and the following main scanning are easily aggregated into a collection of a plurality of dots.

6. The printing apparatus according to claim 5, wherein the mask has a configuration with an excellent ON data aggregation property rather than a mask which has an excellent discreteness which is created with a predetermined method.

* * * * *